US008021541B2

(12) United States Patent
Green

(10) Patent No.: US 8,021,541 B2
(45) Date of Patent: Sep. 20, 2011

(54) COOLANT INSPECTION AND FILTERING SYSTEM PATENT

(75) Inventor: Michael Philip Green, Pleasant Hill, CA (US)

(73) Assignee: Vehicle Enhancement Labs, Bellflower, CA (US)

( * ) Notice: Subject to any disclaimer, the term of this patent is extended or adjusted under 35 U.S.C. 154(b) by 1037 days.

(21) Appl. No.: 11/418,965

(22) Filed: May 8, 2006

(65) Prior Publication Data

US 2007/0256649 A1 Nov. 8, 2007

(51) Int. Cl.
*B01D 35/02* (2006.01)
*B01D 35/06* (2006.01)
*B03C 1/02* (2006.01)

(52) U.S. Cl. ..... 210/94; 210/117; 210/130; 210/167.01; 210/167.29; 210/223; 210/232; 210/446; 210/453

(58) Field of Classification Search ..... 210/94, 210/130, 167.01, 167.29, 223, 232, 446, 210/453, 117
See application file for complete search history.

(56) References Cited

U.S. PATENT DOCUMENTS 4,379,052 A * 4/1983 Stearns ..... 210/223
4,759,842 A * 7/1988 Frees et al. ..... 210/94
4,783,266 A * 11/1988 Titch et al. ..... 210/695
6,139,737 A * 10/2000 Gizowski ..... 210/223
6,251,265 B1 * 6/2001 Stein ..... 210/117

* cited by examiner

*Primary Examiner* — David A Reifsnyder
(74) *Attorney, Agent, or Firm* — Novak Druce + Quigg LLP

(57) ABSTRACT

The present invention relates to an automotive engine cooling system and the ability to filter contaminates from the cooling system liquid thus slowing down metal erosion of internal cooling system components. The present invention also allows the user to visually see the condition of the filtering device and the condition of the cooling system liquid. If the filtering device should plug or clog, a by-pass system is in place to allow the cooling system liquid to continue circulation not affecting the vehicle's engine temperature.

10 Claims, 3 Drawing Sheets

COOLANT INSPECTION AND FILTERING SYSTEM PATENT

BACKGROUND OF THE INVENTION

This invention pertains to an automotive engine cooling system and the inspection and filtration of its cooling system liquid. With many different types of metals and plastics commonly found and in contact with the re-circulating cooling system liquid, softer materials overtime will erode producing contaminating materials that mixes in with the cooling system liquid give it a grit texture. As this contamination in the cooling system liquid increases in volume, due to the vehicle's cooling system being neglected, a sand paper affect is then created and wears the softer internal materials predominantly around curves or bends of the internal passages of the vehicle's cooling system. Overtime this damage can cause premature failure of key cooling system components. This filtration system catches the cooling system liquid contaminates thus reducing cooling system erosion and enables the user to visually inspect the condition of the filter and the cooling system liquid.

BRIEF SUMMARY OF THE INVENTION

The present invention filters the cooling system liquid used to cool an automotive engine. The present invention is designed to be installed into the heater core liquid supply hose for the purpose of catching cooling system contaminates and reduces liquid pressure prior to entering either the heater core control valve or the heater core. Contamination in the cooling system liquid, when under pressure from either liquid expansion or the vehicle's liquid circulating pump, causes a sand paper affect on the internal passages of the cooling system. This sand paper affect overtime erodes the softer materials causing holes or external leaks to develop and a loss of cooling system liquid resulting in the vehicle's cooling system to fail. Clear temper glass is used to house the filter which provides inspection of the filter and the condition of the cooling system liquid. A magnet is placed at the inlet housing of the filter to trap larger particles and not allowing them to trap inside the valve body of a common filter type by-pass valve system. If circulation is restricted due to filter plugging, increase cooling liquid pressure builds up and opens the by-pass valve system allowing the cooling liquid to continue circulation to the vehicle's engine and not affecting its temperature. The present invention also allows for a replaceable filter cartridge or the inspection and filtering system can be removed from the vehicle and a reverse flushing method can be used to clean it.

DETAILED DESCRIPTION OF THE DRAWINGS

Figure 1:
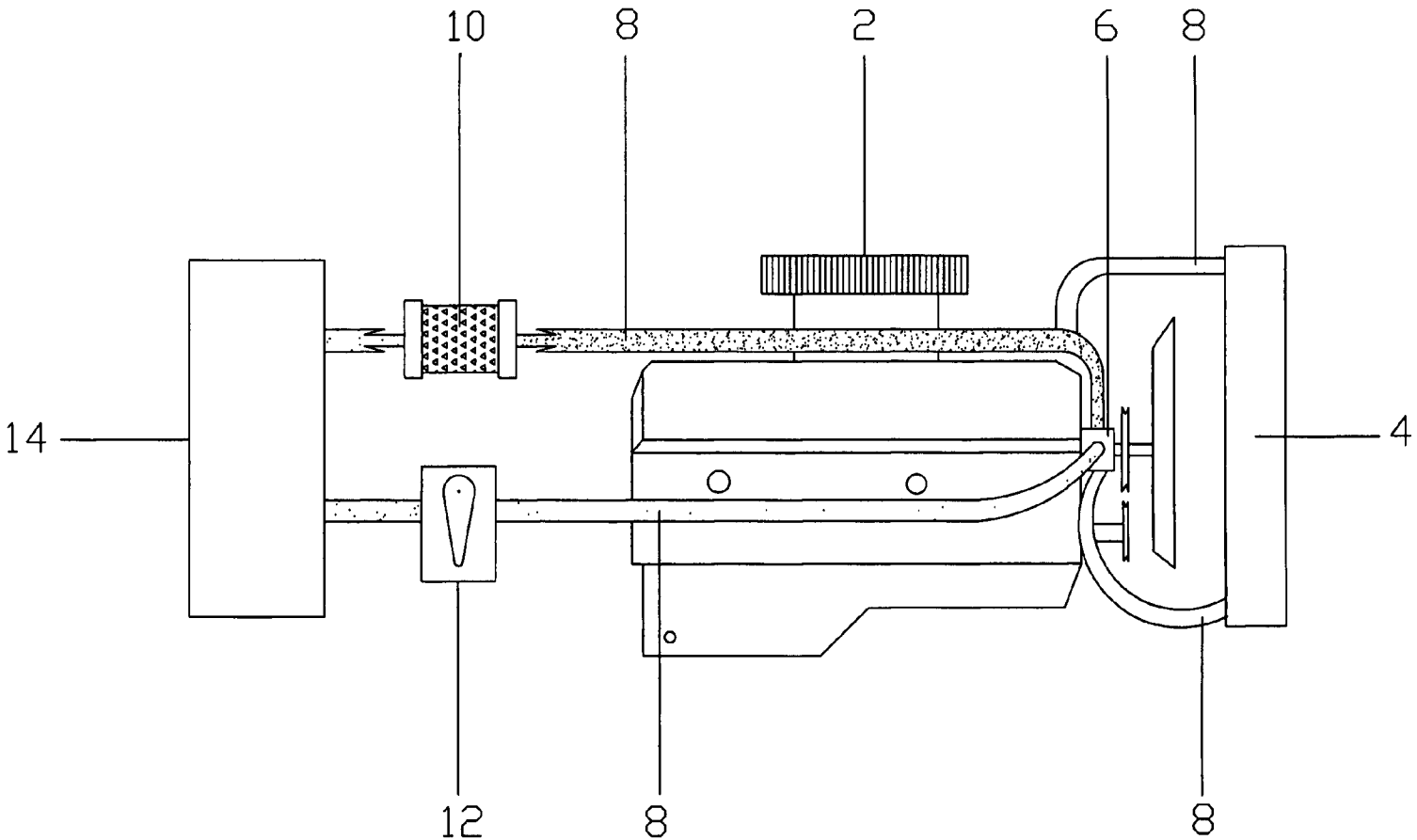
FIG. 1 illustrates the perspective side view of related art for the present invention.

FIG. 1 shows the related art of the present invention, the vehicle's engine 2 depends on a cooling system liquid which is circulated by a liquid pump 6 to a heat exchange system 4 used to transfer heat out of the cooling system liquid. The circulating cooling system liquid is provided a path to travel to external cooling system components by a series of hoses or tubes 8. The present invention, the inspection and filtering system 10 is design to filter out contaminates which speeds up the erosion process of internal cooling system components and allows a visual inspection of both the cooling system liquid and the filter allowing the knowledge to know when either the cooling system liquid or filter needs to be replaced. The inspection and filtering system 10 is designed to install into the cooling system liquid passage hoses or tubes 8 prior to entering or exiting the heater core 14 which is designed to provide heat to the interior of the vehicle. The heater core control valve 12 regulates the amount of cooling system liquid flow to the heater core 14 and switches the liquid flow on or off.

Figure 2:
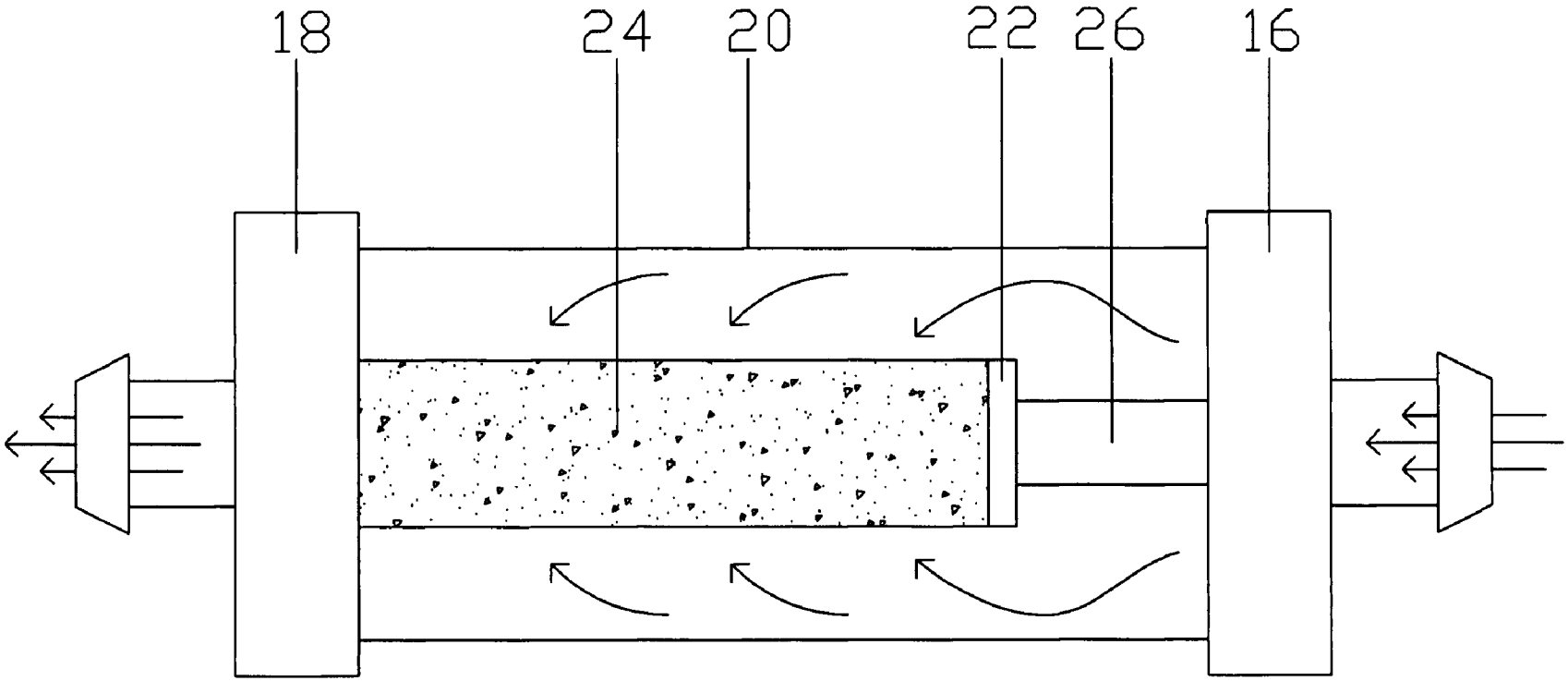
FIG. 2 illustrates a phantom operational view of the present invention.

FIG. 2 shows a phantom operational view of the present invention and how the cooling system liquid flows into the inlet housing 16 and passes into the glass center housing 20. The glass center housing allows clear viewing of the connector bar 26 which holds the assembly together, the magnet 22 catches and retains larger cooling system contaminates before the cooling system liquid passes through the filter 24 which traps the finer contaminates. After the filtering process is completed the cooling system liquid continues out the outlet housing 18 and continues on with circulating through the vehicle's engine cooling system.

Figure 3:
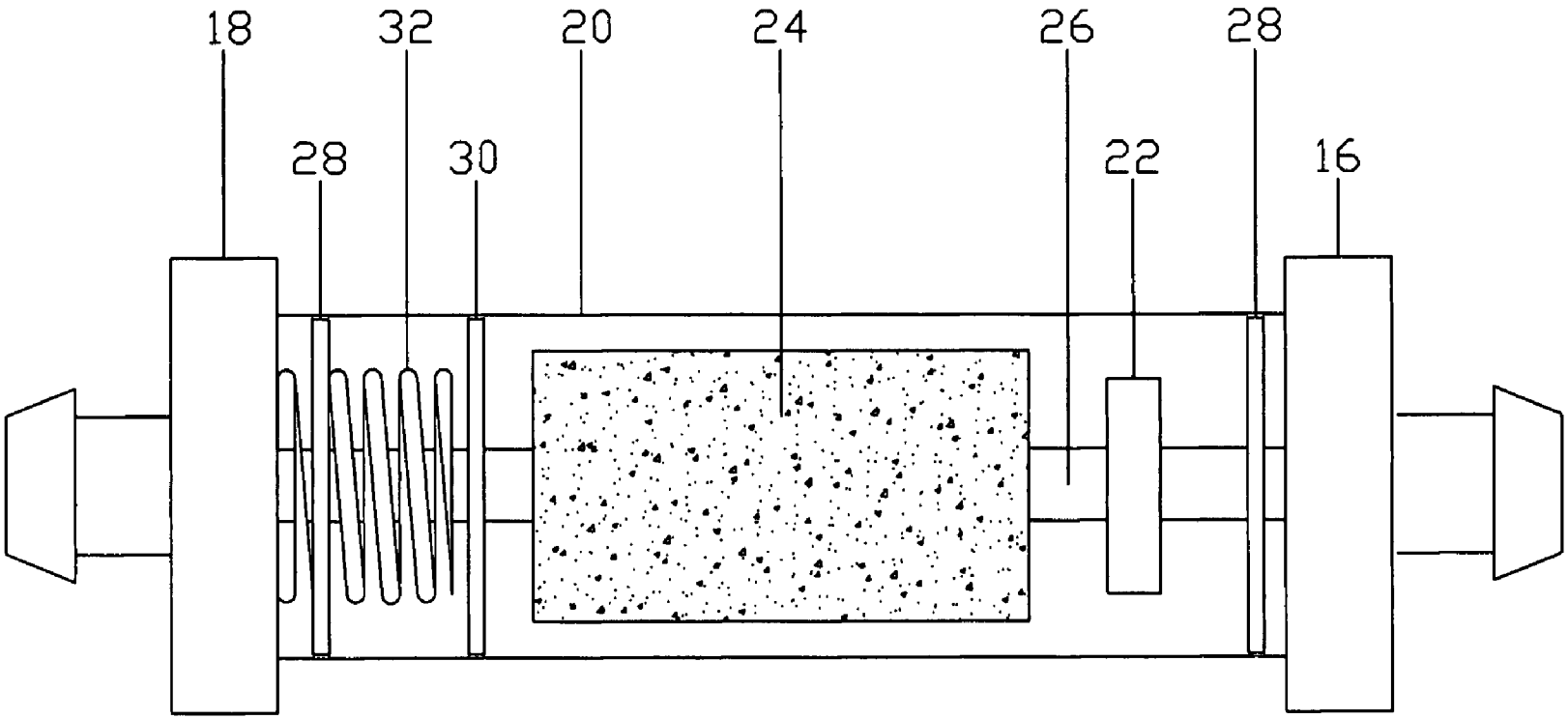
FIG. 3 illustrates a detailed description for the present invention.

FIG. 3 shows a detailed illustration of the present invention. The cooling system liquid flows into the inspection and filtering system through the inlet housing 16. Upon entering, the liquid meets resistance against the by-pass sealing ring 30 forcing the cooling liquid to flow through the filter which traps cooling system contamination. The cooling liquid after passing through the filter 24 continues its flow exiting out the inspection and filtering system through the outlet housing 18. Both the inlet housing 16 and outlet housing 18 are sealed to the glass center housing 20 by sealing gaskets 28.

The housings are connected together by a male threaded connector bar 26 that spans the distance between the housings and allows connection of the female threaded inlet housing 16 to a sealing gasket 28 which is positioned between the inlet housing 16 and the inlet side of the glass center housing 20. A second sealing gasket 28 is positioned between the outlet side of the glass center housing 20 and the female threaded outlet housing 18. When the inlet housing 16 and the outlet housing 18 are threaded onto the connector bar 26 and tighten against the sealing gaskets 28 and the glass center housing 20, a liquid proof seal is then achieved. As the cooling system liquid enters into the inspection and filtering system the first contact is made with a magnet 22 which catches and retains the larger metal contaminates such as rust flakes. The magnet 22 does not allow the larger contaminates to trap between the filter 24 and the by-pass sealing ring 30. If contaminates are trapped between the by-pass sealing ring 30 and the filter 24, it will provide a path for the cooling liquid to flow passed and not through the filter 24. The by-pass resistance is controlled by the by-pass spring 32 which controls the amount resistance pressure needed to operate the by-pass system. When cooling system liquid pressure increases due to a plugged or clogged filter 24 the by-pass sealing ring 30 opens and provide a path of a lesser resistance allowing the cooling system liquid to flow passed the filter 24 and exit out between the by-pass sealing ring 30 and the filter 24. Once contaminates are trapped in the filter 24 they are no longer allowed to flow in or with the cooling liquid slowing down or eliminating the erosion of cooling system components.

What is claimed is:

1. An inspection and filtering cooling system of an automotive engine, the system comprising:

an automotive engine comprising a recirculating coolant liquid flow path into, through and exiting from, the engine;

a pump to circulate the coolant liquid;

a heating core operatively connected to the coolant liquid flow path;

a transparent filter housing disposed in fluid connection in the coolant liquid flow path between the engine and the heating core; the housing having an inlet and an outlet;

the transparent filter housing creating a housing flow path which is annular in shape about a central bar after entering the inlet;

a filter disposed in the housing flow path whereby the housing flow path is changed from annular to cylindric shape after passing through the filter; and continues through the outlet in the cylindric shape; and, a magnet placed upstream of the filter in the annular flow path, whereby any magnetic particles in the coolant liquid in the annular flow path contact the magnet before contacting the filter while the coolant liquid is flowing through the transparent filter housing.

2. The cooling system of claim 1, wherein the magnet is positioned immediately upstream of the filter in the transparent filter housing.

3. The cooling system of claim 1, wherein the transparent filter housing comprises tempered glass.

4. The cooling system of claim 1, wherein said inlet permits coolant fluid to enter the transparent filter housing and initially contact the magnet placed in the flow path of the coolant fluid before said fluid contacts the filter disposed downstream of the magnet but still positioned within the transparent filter housing, such that the coolant liquid is initially subjected to magnetic force and magnetic particles in the fluid are attracted to the magnet and subsequent filtering magnetic particle free fluid within said transparent filter housing.

5. The coolant system of claim 4, further comprising a bypass sealing ring positioned within the transparent filter housing, the sealing ring positioned downstream of the filter, and a by-pass spring positioned downstream of the sealing ring, the by-pass spring exerting a bias on the sealing ring.

6. The coolant system of claim 5, further comprising a flow path around the filter when a pressure increase in said filter housing is greater than the bias imparted on the sealing ring by said by-pass spring.

7. The system of claim 6, wherein the flow path around said filter indicates the filter is clogged.

8. The system of claim 4, further comprising a hose connecting an outlet of the transparent filter housing to the heater core.

9. The system of claim 1, wherein the transparent filter housing comprises at least an inlet section and an outlet section, and a center section; at least the inlet and outlet sections being threadedly mounted on the bar so as to be forced against the center section.

10. The system of claim 9, further comprising a seal between the center section and each of the inlet and outlet sections.

* * * * *